US010935907B2

(12) United States Patent
Ishizuka et al.

(10) Patent No.: US 10,935,907 B2
(45) Date of Patent: Mar. 2, 2021

(54) DEVELOPER CONVEYANCE DEVICE AND IMAGE FORMING APPARATUS INCORPORATING SAME

(71) Applicants: Yusuke Ishizuka, Kanagawa (JP); Akira Fujimori, Kanagawa (JP); Hideki Kimura, Kanagawa (JP); Yutaka Takahashi, Kanagawa (JP); Hiroshi Kikuchi, Kanagawa (JP); Hiroyuki Uenishi, Kanagawa (JP); Johji Yahagi, Kanagawa (JP)

(72) Inventors: Yusuke Ishizuka, Kanagawa (JP); Akira Fujimori, Kanagawa (JP); Hideki Kimura, Kanagawa (JP); Yutaka Takahashi, Kanagawa (JP); Hiroshi Kikuchi, Kanagawa (JP); Hiroyuki Uenishi, Kanagawa (JP); Johji Yahagi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/876,134

(22) Filed: May 18, 2020

(65) Prior Publication Data

US 2020/0387085 A1 Dec. 10, 2020

(30) Foreign Application Priority Data

Jun. 6, 2019 (JP) ..... JP2019-105807
Apr. 1, 2020 (JP) ..... JP2020-065919

(51) Int. Cl.
*G03G 15/08* (2006.01)
*G03G 15/095* (2006.01)

(52) U.S. Cl.
CPC ..... *G03G 15/0891* (2013.01); *G03G 15/095* (2013.01)

(58) Field of Classification Search
CPC ..... G03G 15/0891; G03G 15/095
See application file for complete search history.

(56) References Cited

U.S. PATENT DOCUMENTS

2011/0081168 A1* 4/2011 Kimura ..... G03G 15/0872 399/258
2014/0314461 A1 10/2014 Ishizuka et al.
(Continued)

FOREIGN PATENT DOCUMENTS

| | | |
|---|---|---|
| JP | 7-092875 | 4/1995 |
| JP | 2013-231781 | 11/2013 |
| JP | 2015-180976 | 10/2015 |

*Primary Examiner* — Francis C Gray
(74) *Attorney, Agent, or Firm* — Xsensus LLP

(57) ABSTRACT

A developer conveyance device includes a downward conveyance path in which a developer falls under gravity, a transverse conveyance path communicating with a lower end of the downward conveyance path and extending in a transverse direction intersecting with the downward conveyance path, a transport screw disposed in the transverse conveyance path, and a floating member. The transport screw is configured to rotate in a predetermined direction to transport the developer in the transverse direction. The floating member is configured to contact the transport screw rotating in the predetermined direction to float in the downward conveyance path.

20 Claims, 5 Drawing Sheets

(56) References Cited

U.S. PATENT DOCUMENTS

| | | | | |
|---|---|---|---|---|
| 2015/0078795 | A1* | 3/2015 | Kuwabara | G03G 21/105 399/358 |
| 2015/0227107 | A1 | 8/2015 | Ishizuka et al. | |
| 2016/0147181 | A1* | 5/2016 | Inoue | G03G 15/0879 399/27 |
| 2017/0261887 | A1* | 9/2017 | Ishizuka | G03G 15/0891 |

* cited by examiner

DEVELOPER CONVEYANCE DEVICE AND IMAGE FORMING APPARATUS INCORPORATING SAME

CROSS-REFERENCE TO RELATED APPLICATIONS

This patent application is based on and claims priority pursuant to 35 U.S.C. § 119(a) to Japanese Patent Application Nos. 2019-105807, filed on Jun. 6, 2019 and 2020-065919, filed on Apr. 1, 2020, in the Japan Patent Office, the entire disclosure of each of which is hereby incorporated by reference herein.

BACKGROUND

Technical Field

Embodiments of the present disclosure generally relate to a developer conveyance device to transport a developer such as excess toner, and an image forming apparatus, such as a copier, a printer, a facsimile machine, or a multifunction peripheral (MFP) having at least two of such capabilities, incorporating the developer conveyance device.

Description of the Related Art

In certain image forming apparatuses, such as copiers, printers, and the like, a downward conveyance path and a transverse conveyance path transport a developer such as excess toner. The developer falls in the downward conveyance path under gravity. As a transport screw rotates in the transverse conveyance path, the developer flowing from the downward conveyance path is transported in a transverse direction.

SUMMARY

Embodiments of the present disclosure describe an improved developer conveyance device that includes a downward conveyance path in which a developer falls under gravity, a transverse conveyance path communicating with a lower end of the downward conveyance path and extending in a transverse direction intersecting with the downward conveyance path, a transport screw disposed in the transverse conveyance path, and a floating member. The transport screw is configured to rotate in a predetermined direction to transport the developer in the transverse direction. The floating member is configured to contact the transport screw rotating in the predetermined direction to float in the downward conveyance path.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
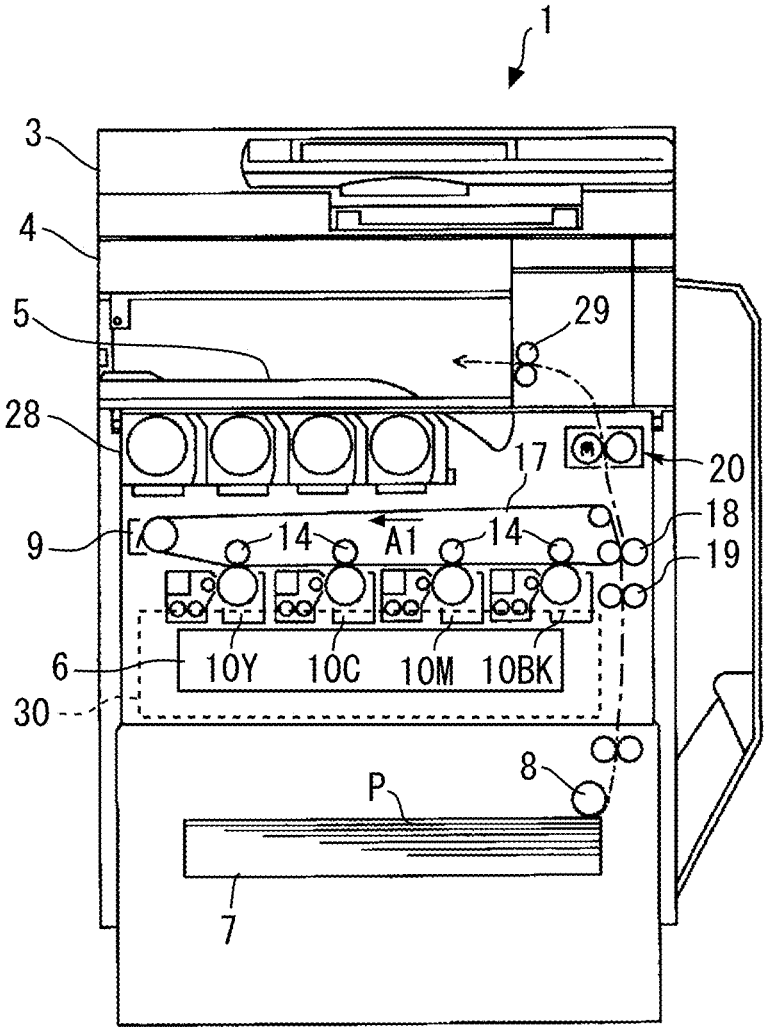
FIG. 1 is a schematic view illustrating a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views, and redundant descriptions are omitted or simplified below as required.

DETAILED DESCRIPTION

Embodiments of the present disclosure are described in detail with reference to drawings.

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a", "an", and "the" are intended to include the plural forms as well, unless the context clearly indicates otherwise.

It is to be noted that the suffixes Y, M, C, and BK attached to each reference numeral indicate only that components indicated thereby are used for forming yellow, magenta, cyan, and black images, respectively, and hereinafter may be omitted when color discrimination is not necessary.

A configuration and operation of an image forming apparatus 1 is described below with reference to FIG. 1.

In FIG. 1, the image forming apparatus 1, which is a tandem-type color copier in the present embodiment, includes a document conveyance device 3, a scanner (document reading device) 4, and an exposure device (writing device) 6. The document conveyance device 3 transports documents to the scanner 4. The scanner 4 scans image data for the documents. The exposure device 6 emits a laser beam based on input image data.

The image forming apparatus 1 also includes a sheet feeder 7, process cartridges 10Y, 10M, 10C, and 10BK, an intermediate transfer belt 17, and a secondary transfer roller 18. The sheet feeder 7 accommodates sheets of paper P or the like. The process cartridges 10Y, 10M, 10C, and 10BK are image forming units to form yellow, magenta, cyan, and black toner images, respectively. The intermediate transfer belt 17 serves as an image bearer onto which the toner images of multiple colors are transferred and superimposed. The secondary transfer roller 18 transfers the toner images on the intermediate transfer belt 17 to the sheet P.

The image forming apparatus 1 further includes a fixing device 20, toner containers 28, and an excess toner receptacle 30. The fixing device 20 fixes unfixed toner images on the sheet P. The toner containers 28 contain toners of respective colors to be supplied to developing devices 13 (see FIG. 2) of the corresponding process cartridges 10Y, 10M, 10C, and 10BK. Excess toner is collected in the excess toner receptacle 30.

Figure 2:
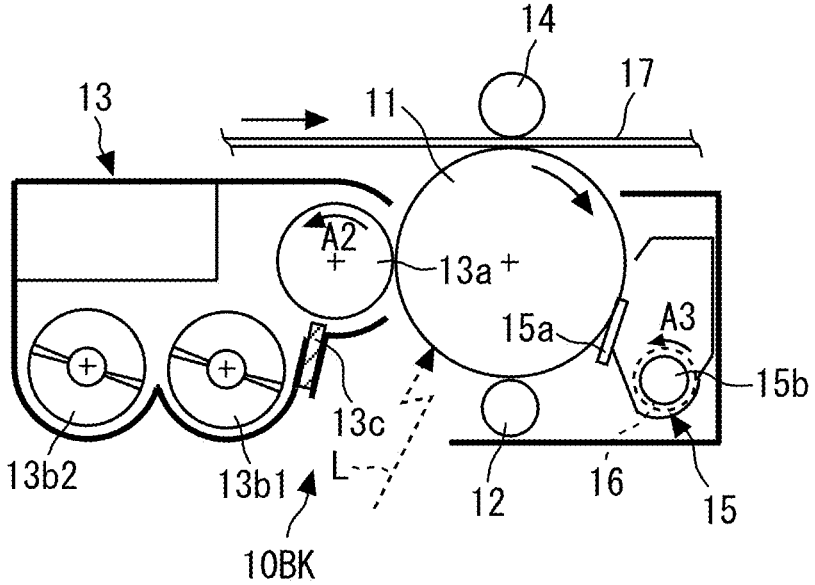
FIG. 2 is a schematic view illustrating a configuration of an image forming unit of the image forming apparatus in FIG. 1.

Each of the process cartridges 10Y, 10M, 10C, and 10BK as the image forming units includes a photoconductor drum 11 as an image bearer, a charging device 12, the developing device 13, and a cleaning device 15, which are united as a single unit as illustrated in FIG. 2. Each of the process cartridges 10Y, 10M, 10C, and 10BK, which are expendable, is replaced with a new one when depleted. In the process cartridges 10Y, 10M, 10C, and 10BK, yellow, magenta, cyan, and black toner images are formed on the respective photoconductor drums 11.

A description is provided below of the operation of the image forming apparatus 1 to form a normal color image.

A conveyance roller of the document conveyance device 3 transports a document on a document table onto a platen (exposure glass) of the scanner 4. Then, the scanner 4 optically scans image data for the document on the platen. The yellow, magenta, cyan, and black image data are transmitted to the exposure device 6. The exposure device 6 irradiates the photoconductor drums (image bearers) 11 of the corresponding process cartridges 10Y, 10M, 10C, and 10BK with laser beams (exposure light) L based on the yellow, magenta, cyan, and black image data, respectively.

Meanwhile, the four photoconductor drums 11 rotate clockwise in FIGS. 1 and 2. With reference to FIG. 2, it can be seen that the charging device 12 (e.g., a charging roller) uniformly charges the surface of the photoconductor drum 11 at a position opposite each other (charging process). Thus, the surface of the photoconductor drum 11 is charged to a certain potential. Subsequently, the surface of the photoconductor drum 11 thus charged reaches a position where the surface of the photoconductor drum 11 is irradiated with the laser beam L.

The exposure device 6 emits the laser beams L for respective colors from a light source according to the image data. The laser beams L are reflected by a polygon mirror and transmitted through multiple lenses. The transmitted laser beams L pass through different optical paths for the different components of yellow, magenta, cyan, and black (exposure process).

The laser beam L corresponding to a yellow component is directed to the surface of photoconductor drum 11 in the process cartridge 10Y, which is the first from the left in FIG. 1 among the four process cartridges 10Y, 10M, 10C, and 10BK. Thus, an electrostatic latent image for yellow is formed on the photoconductor drum 11 charged by the charging device 12.

Similarly, the laser beam L corresponding to a cyan component is directed to the surface of the photoconductor drum 11 in the second process cartridge 10C from the left in FIG. 1, thus forming an electrostatic latent image for cyan on the surface of the photoconductor drum 11. The laser beam L corresponding to a magenta component is directed to the surface of the photoconductor drum 11 in the third process cartridge 10M from the left in FIG. 1, thus forming an electrostatic latent image for magenta on the photoconductor drum 11. The laser beam L corresponding to a black component is directed to the surface of the photoconductor drum 11 in the fourth process cartridge 10BK from the left in FIG. 1, thus forming an electrostatic latent image for black on the photoconductor drum 11.

Then, the surface of the photoconductor drum 11 having the electrostatic latent image reaches a position opposite the developing device 13 (see FIG. 2). The developing device 13 deposits toner of each color onto the surface of the photoconductor drum 11 and develops the electrostatic latent image on the photoconductor drum 11 into a toner image (development process).

Subsequently, the surface of the photoconductor drum 11 after the development process reaches a position facing the intermediate transfer belt 17 as the image bearer. The primary transfer rollers 14 are disposed at positions where the photoconductor drums 11 face the intermediate transfer belt 17 and in contact with an inner circumferential face of the intermediate transfer belt 17, respectively. At the positions of the primary transfer rollers 14, the toner images on the photoconductor drums 11 are transferred to and superimposed on the intermediate transfer belt 17, forming a multicolor toner image thereon (primary transfer process).

After the primary transfer process, the surface of the photoconductor drum 11 reaches a position opposite the cleaning device 15 (see FIG. 2). The cleaning device 15 collects untransferred toner remaining on the photoconductor drum 11 (cleaning process). Then, the surface of the photoconductor drum 11 passes through a discharge device to complete a series of image forming processes performed on the photoconductor drum 11.

Meanwhile, the surface of the intermediate transfer belt 17, onto which the single-color toner images on the photoconductor drums 11 are superimposed, moves in the direction indicated by arrow A1 in FIG. 1 and reaches a position opposite the secondary transfer roller 18. The secondary transfer roller 18 secondarily transfers the multicolor toner image on the intermediate transfer belt 17 to the sheet P (secondary transfer process).

After the secondary transfer process, the surface of the intermediate transfer belt 17 reaches a position opposite a belt cleaning device 9. The belt cleaning device 9 collects untransferred toner on the intermediate transfer belt 17 to complete a series of transfer processes on the intermediate transfer belt 17.

The sheet P is transported to the position of the secondary transfer roller 18, via a sheet conveyance guide, a registration roller pair 19, and the like, from the sheet feeder 7.

More specifically, a sheet feeding roller 8 feeds the sheet P from the sheet feeder 7 that accommodates a stack of sheets P, and the sheet P is then guided by the sheet conveyance guide to the registration roller pair 19. The sheet P that has reached the registration roller pair 19 is transported toward the position of the secondary transfer roller 18, timed to coincide with the arrival of the multicolor toner image on the intermediate transfer belt 17.

Subsequently, the sheet P, onto which the multicolor image is transferred, is transported to the fixing device 20. The fixing device 20 includes a fixing roller and a pressure roller pressing against each other. In a nip between the fixing roller and the pressure roller, the multicolor toner image is fixed on the sheet P.

After the fixing process, an output roller pair 29 ejects the sheet P as an output image outside the image forming apparatus 1, and the ejected sheet P is stacked on an output tray 5 to complete a series of image forming processes.

Next, the process cartridge (image forming unit) 10BK of the image forming apparatus 1 are described in further detail below with reference to FIG. 2. FIG. 2 is a schematic view of the process cartridge 10BK for black. Other three process cartridges 10Y, 10M, and 10C have a similar configuration to that of the process cartridge 10BK for black except for the color of toner used in image forming processes, and thus drawings and descriptions thereof are omitted to avoid redundancy.

As illustrated in FIG. 2, the process cartridge 10BK is a single unit that accommodates the photoconductor drum 11 as the image bearer, the charging device 12 to charge the photoconductor drum 11, the developing device 13 to develop the electrostatic latent image on the photoconductor drum 11, the cleaning device 15 to remove untransferred toner from the photoconductor drum 11 in a casing of the process cartridge 10BK.

The photoconductor drum 11 used in the present embodiment is an organic photoconductor designed to be charged with a negative polarity and which includes a photosensitive layer formed on a drum-shaped conductive support. The charging device 12 is the charging roller including a conductive core and an elastic layer of moderate resistivity coated on the conductive core. Receiving a predetermined voltage from a power supply, the charging device 12 uniformly charges the surface of the photoconductor drum 11 opposite the charging device 12.

The developing device 13 includes a developing roller 13*a* disposed opposite the photoconductor drum 11, a first conveying screw 13*b*1 disposed opposite the developing roller 13*a*, a second conveying screw 13*b*2 disposed opposite the first conveying screw 13*b*1 via a partition, and a doctor blade 13*c* disposed opposite the developing roller 13*a*. The developing roller 13*a* includes multiple magnets and a sleeve that rotates around the magnets. The magnets are stationary and generate magnetic poles around the circumference of the developing roller 13*a*. The magnets generate a plurality of magnetic poles on the sleeve of the developing roller 13*a* to bear a developer on the developing roller 13*a*. The developing device 13 contains the two-component developer including carrier and toner.

Figure 3:
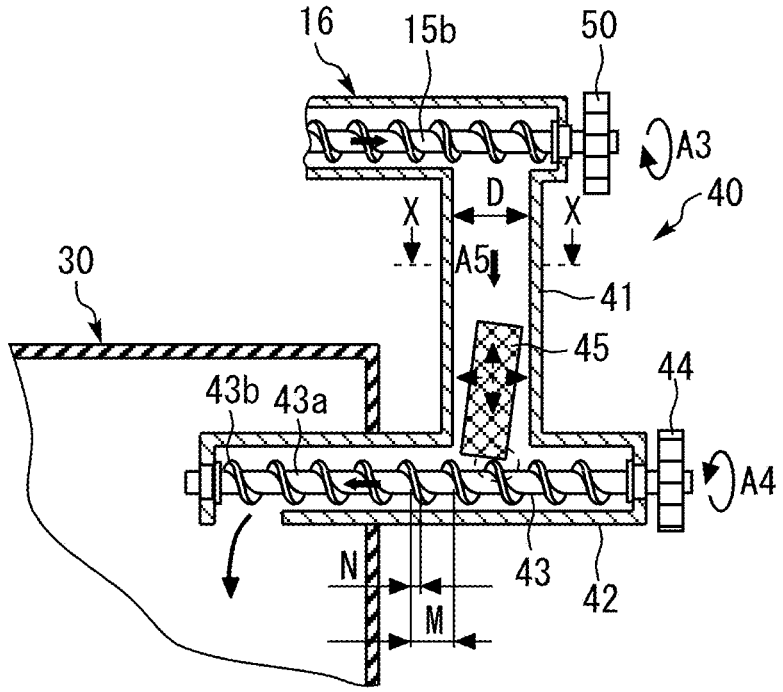
FIG. 3 is a cross-sectional view of a part of an excess toner conveyance device of the image forming apparatus in FIG. 1.

The cleaning device 15 includes a cleaning blade 15*a* that contacts the photoconductor drum 11, and a conveying screw 15*b* disposed in a conveyance tube 16 to transport untransferred toner collected in the cleaning device 15 as excess toner toward an excess toner receptacle 30 (see FIG. 3). For example, the cleaning blade 15*a* is made of rubber, such as urethane rubber, and contacts the surface of the photoconductor drum 11 at a predetermined angle and with a predetermined pressure. With this configuration, substances such as untransferred toner adhering to the photoconductor drum 11 are mechanically scraped off and collected in the cleaning device 15. An excess toner conveyance device 40 (see FIG. 3) as a developer conveyance device transports the untransferred toner collected in the cleaning device 15 to the excess toner receptacle 30 via the conveyance tube 16 in which a conveying screw 15*b* is disposed. The transported untransferred toner is collected in the excess toner receptacle 30 as excess toner. The conveying screw 15*b* is driven by a drive motor via a gear 50 (see FIG. 3) and rotates in the direction indicated by arrow A3 in FIGS. 2 and 3.

Similarly, the belt cleaning device 9 illustrated in FIG. 1 includes a cleaning blade that contacts the intermediate transfer belt 17 and a conveying screw disposed in a conveyance tube 16 to transport untransferred toner collected in the belt cleaning device 9 as excess toner toward the excess toner receptacle 30 (illustrated in FIG. 3). The excess toner conveyance device 40 transports the untransferred toner collected in the belt cleaning device 9 to the excess toner receptacle 30 via the conveyance tube 16 in which the conveying screw is disposed. Thus, the untransferred toner is collected in the excess toner receptacle 30 as excess toner. A detailed description of the excess toner conveyance device 40 is deferred.

In addition to the untransferred toner, the substances adhering to the photoconductor drum 11 or the intermediate transfer belt 17 include paper dust resulting from the sheet P, discharge products generated on the photoconductor drum 11 during discharge by the charging device 12, additives to toner, and the like. In the present specification, such substances are collectively referred to as "untransferred toner".

The image forming processes are described in further detail below with continued reference to FIG. 2.

The developing roller 13*a* rotates counterclockwise indicated by arrow A2 in FIG. 2. In the developing device 13, as the first and second conveying screws 13*b*1 and 13*b*2 arranged via the partition rotate, the developer is circulated in the longitudinal direction of the developing device 13, being stirred and mixed with toner supplied from the toner container 28 by a toner supply device. The longitudinal direction of the developing device 13 is perpendicular to the surface of the paper on which FIG. 2 is drawn.

Thus, the toner is triboelectrically charged and attracted to the carrier. Then, the toner is carried on the developing roller 13*a* together with the carrier. The developer carried on the developing roller 13*a* reaches the doctor blade 13*c*. The amount of the developer on the developing roller 13*a* is adjusted to a suitable amount by the doctor blade 13*c*, after which the developer is transported to a development range opposite the photoconductor drum 11.

In the development range, toner in the developer adheres to the electrostatic latent image on the surface of the photoconductor drum 11. Specifically, the toner adheres to the electrostatic latent image by a development electric field formed by a potential difference (i.e., a developing potential) between a latent image potential (i.e., an exposure potential) of an image area irradiated with the laser beam L and a development bias applied to the developing roller 13*a*, thereby forming a toner image.

Subsequently, most of the toner that adheres to the photoconductor drum 11 in the developing process is transferred to the intermediate transfer belt 17, and untransferred toner remaining on the photoconductor drum 11 is collected in the cleaning device 15 by the cleaning blade 15*a*.

A detailed description is given below of the excess toner conveyance device 40 as the developer conveyance device of the image forming apparatus 1 according to the present embodiment with reference to FIG. 3. FIG. 3 is a cross-sectional view of a part of an excess toner conveyance device of the image forming apparatus in FIG. 1. As described above, excess toner as the developer is collected by the cleaning device 15 and the belt cleaning device 9 and transported through the conveyance tube 16. With reference to FIG. 3, it can be seen that the excess toner conveyance device 40 as the developer conveyance device transports the excess toner toward the excess toner receptacle 30 in the direction indicated by thick black arrow A5 in FIG. 3.

That is, as illustrated in FIG. 3, the excess toner conveyance device 40 as the developer conveyance device includes a downward conveyance path 41, a transverse conveyance path 42, a transport screw 43, a floating member 45, and the like.

The replaceable excess toner receptacle 30, which is removable, is installed in the image forming apparatus 1 in such a way that the excess toner receptacle 30 is coupled to the transverse conveyance path 42 of the excess toner conveyance device 40. Thus, the excess toner transported by the excess toner conveyance device 40 is collected in the excess toner receptacle 30.

In the present embodiment, the downward conveyance path 41, in which toner (developer) falls under gravity, extends in the substantially vertical direction. Further, the downward conveyance path 41 in the present embodiment has a circular cross-section with a diameter D along line X-X in FIG. 3.

The transverse conveyance path 42 extends in a transverse direction intersecting the downward conveyance path 41, and an upper portion of the transverse conveyance path 42 communicates with a lower end of the downward conveyance path 41. In the present embodiment, the transverse conveyance path 42 extends straight in the substantially horizontal direction and has a circular cross-section slightly larger than a screw diameter of the transport screw 43 described below.

The transport screw 43 is disposed in the transverse conveyance path 42 and rotates in a predetermined direction indicated by arrow A4 in FIG. 3 to transport toner in the transverse direction. The transport screw 43 includes a shaft 43*a* and a thread 43*b* wound around the shaft 43*a*. The transport screw 43 is driven by a drive motor via a gear 44 and rotates in the direction indicated by arrow A4 in FIG. 3. Both ends of the transport screw 43 in an axial direction are rotatably supported by a housing of the excess toner conveyance device 40. In the present embodiment, both of the shaft 43*a* and the thread 43*b* of the transport screw 43 is made of a metal material having high mechanical strength, such as stainless steel.

In the present embodiment, the downward conveyance path 41 extends in the substantially vertical direction. Alternatively, a downward conveyance path with any shape in which excess toner falls under gravity can be used, for example, with a sloped face inclined relative to the vertical direction, on which excess toner slides down under gravity.

Further, in the present embodiment, the transverse conveyance path 42 extends in the substantially horizontal direction. Alternatively, a transverse conveyance path with any shape in which excess toner is transported in the transverse direction by the transport screw 43 can be used. Thus, for example, a shape with a sloped face inclined relative to the horizontal direction, or with a partly or entirely curved portion, is also feasible.

In the present embodiment, a floating member 45 is movably disposed in the downward conveyance path 41 of the excess toner conveyance device 40. The floating member 45 floats in the downward conveyance path 41 by contact with the transport screw 43 rotating in the predetermined direction indicated by arrow A4 in FIG. 3 and randomly hits the inner wall of the downward conveyance path 41, thereby preventing excess toner from adhering to the inner wall of the downward conveyance path 41.

Specifically, the floating member 45 extends in substantially the same direction as the vertical direction in which the downward conveyance path 41 extends. The floating member 45 is disposed on the transport screw 43 and movable freely in the downward conveyance path 41 without being supported by any components.

The floating member 45 has a diameter R of the cross-section (see FIG. 4) greater than a gap between the transport screw 43 and the transverse conveyance path 42 so that the floating member 45 floats on the rotating transport screw 43 without entering the gap.

Accordingly, the floating member 45 may move leftward in FIG. 3 along the rotation of the transport screw 43 and collide with the inner wall on the left side of the downward conveyance path 41, or may rebound from the inner wall or lose balance at the upper portion of the floating member 45, thereby colliding with the inner wall on the other side. As a result, the floating member 45 randomly rocks in any direction with a free posture, and collides with the inner wall of the downward conveyance path 41 almost uniformly.

Thus, the floating member 45 moves in a relatively wide range upward from the lower end of the downward conveyance path 41 where the transverse conveyance path 42 communicates with, and collides with the substantially entire circumference of the inner wall of the downward conveyance path 41, thereby preventing excess toner from adhering to the inner wall of the downward conveyance path 41. Even if excess toner adheres to the inner wall of the downward conveyance path 41, the toner adhering to the inner wall can be removed by the collision of the floating member 45. Therefore, the adhering toner does not block the downward conveyance path 41.

In particular, toner is less likely adhere to the upper portion of the inner wall of the downward conveyance path 41 and likely to adhere to the portion ranging from the lower end to the center. Therefore, the floating member 45 having a length H (see FIG. 4) that can collide with such a range is useful to remove the adhering toner. Further, since excess toner is more likely to adhere to the inner wall of the downward conveyance path 41 than new toner (fresh toner), the floating member 45 provided in the downward conveyance path 41 for excess toner is useful.

In the present embodiment, the hardness of the floating member 45 is smaller than the hardness of the transport screw 43. Specifically, in the present embodiment, the floating member 45 is made of a material such as a rubber material or a resin material, and softer than the transport screw 43 made of a metal material. The floating member 45 softer than the transport screw 43 can prevent the transport screw 43 from being worn due to repeated contact with the floating member 45. Therefore, the good toner transportability by the transport screw 43 is retained over time. Note that the hardness of the floating member 45 may be smaller than the hardness of the transport screw 43 as a whole, or only at the surface of the floating member 45. That is, the hardness of at least the outer surface of the floating member 45 can be smaller than the hardness of the transport screw 43.

The floating member 45 can become worn due to repeated contact with the transport screw 43, but the worn portion is limited to the bottom portion that contacts the transport screw 43, and a portion that collides with the inner wall of the downward conveyance path 41 is hardly worn, and the length H (see FIG. 4) of the portion that collides with the inner wall is sufficiently long, so that the function of preventing toner from adhering to the inner wall of the downward conveyance path 41 is retained over time. If a spherical floating member is used, the floating member may be caught between the threads 43*b* of the transport screw 43. However, in the present embodiment, even if the bottom of the floating member 45 is worn, the floating member 45 is not caught between the threads 43*b* of the transport screw 43, thereby preventing the malfunction or breakage of the transport screw 43.

Further, in the present embodiment, the floating member 45 is softer than the inner wall of the downward conveyance path 41, which is made of a relatively strong resin material. This configuration can prevent the downward conveyance path 41 from being worn due to repeated contact with the floating member 45. The hardness of the floating member 45 may be smaller than the hardness of the inner wall of the downward conveyance path 41 as a whole, or only at the surface of the floating member 45. That is, the hardness of at least the outer surface of the floating member 45 can be smaller than that of the inner wall of the downward conveyance path 41.

In the present embodiment, preferably, the floating member 45 is elastic and made of an elastic material such as rubber. Thus, the hardness of the floating member 45 can be considerably reduced as compared with the hardness of the transport screw 43 made of a metal material, thereby preventing the transport screw 43 from being worn. Further, since the floating member 45 is elastic, the rebound when the floating member 45 hits the transport screw 43 or the inner wall of the downward conveyance path 41 is increased by elastic force, causing the floating member 45 to floats greatly. Thus, toner is prevented from adhering to the inner wall of the downward conveyance path 41.

Figure 4:
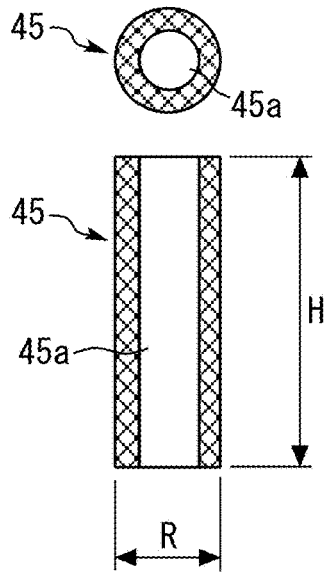
FIG. 4 is a top view and a side cross-sectional view of a floating member of the excess toner conveyance device in FIG. 3.
Figure 5A:
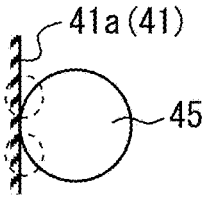
FIGS. 5A and 5B are schematic enlarged views illustrating a state in which the floating member contacts an inner wall of a downward conveyance path of the excess toner conveyance device.
Figure 5B:
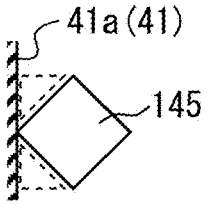

In the present embodiment, as illustrated in FIGS. 4 and 5A, the floating member 45 has a columnar shape. As illustrated in FIG. 5B, when the floating member 145 is cubic, the corners of the floating member 45 hit the inner wall 41*a* of the downward conveyance path 41 and wear down. As a result, the state of collision with the inner wall 41*a* changes over time. Therefore, the effect of preventing toner from adhering to the inner wall 41*a* may change with time. A columnar floating member like the columnar floating member 45 can prevent such a problem.

As illustrated in FIG. 5B, even when the cubic floating member 145 is used, the effect of preventing toner from adhering to the inner wall 41*a* can be attained similarly to the case of the columnar floating member 45 in FIG. 5A. However, when the columnar floating member 45 in FIG. 5A is used, regions, which are not close to the inner wall 41*a*, surrounded by broken lines can be reduced as compared with the cubic floating member 145 in FIG. 5B. Accordingly, the effect of preventing toner from adhering to the inner wall 41*a* is more likely to being attained.

Further, the floating member 45 in the present embodiment can have a hollow tubular shape having a hollow 45*a* formed therein as illustrated in FIG. 4. Since the hollow 45*a* of the floating member 45 reduces the weight of the floating member 45, the transport screw 43 and the inner wall 41*a* are prevented from being worn due to the collision of the floating member 45. Further, since the weight of the floating member 45 is reduced, the rebound when the floating member 45 hits the transport screw 43 or the inner wall 41*a* of the downward conveyance path 41 is increased, causing the floating member 45 to floats greatly. Thus, toner is prevented from adhering to the inner wall of the downward conveyance path 41.

In addition, some excess toner falls through the hollow 45*a* of the floating member 45 under gravity. As compared with no hollow 45*a*, the flow (transportability) of the excess toner in the downward conveyance path 41 can be improved.

With reference to FIGS. 3 and 4, in the present embodiment, the excess toner conveyance device 40 (the floating member 45 and the transport screw 43) satisfies a relation $R>M-N$. Here, R represents a diameter of an inscribed circle of a bottom face (cross-section) of the floating member 45, M represents a screw pitch of the transport screw 43, and N represents a thickness of the thread 43*b* of the transport screw 43. Note that, in the case of the columnar floating member 45 as illustrated in FIG. 5A, the diameter R of the inscribed circle equals an outer diameter of the floating member 45. In the case of the cubic floating member 145 as illustrated in FIG. 5B, the diameter R of the inscribed circle equals a diameter of an inscribed circle of the square cross-section of the floating member 145.

Figure 6:
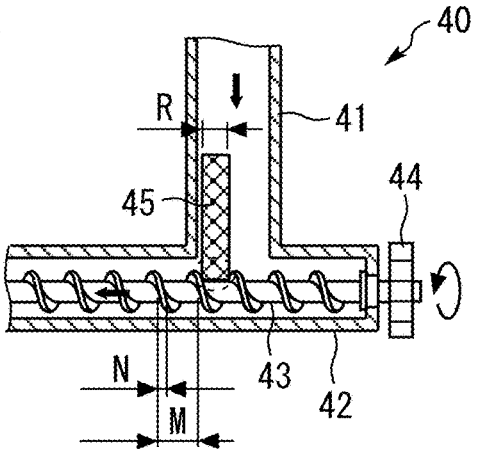
FIG. 6 is a schematic view of the excess toner conveyance device provided with a floating member having a small cross-sectional diameter of a cross-section.

If the above-described relation is not satisfied, then, as illustrated in FIG. 6, the floating member 45 may enter between the threads 43*b* of the transport screw 43, thereby hindering the floating member 45 from floating by contact with the rotating transport screw 43 or causing the floating member 45 to be damaged. On the other hand, in the present embodiment, the dimensions of the related components (e.g., the floating member 45 and the transport screw 43) are determined so that the floating member 45 does not enter between the threads 43*b* of the transport screw 43, thereby preventing such a problem.

With continued reference to FIGS. 3 and 4, in the present embodiment, the excess toner conveyance device 40 (the floating member 45 and the downward conveyance path 41) satisfies a relation $H>D$. Here, H represents the length of the floating member 45, and D represents the diameter of the cross-section inside of the downward conveyance path 41 (the inner diameter of the inner wall 41*a*). If the above-described relation is not satisfied, the floating member 45 may fall down, and the longitudinal direction of the floating member 45 may be greatly inclined with respect to the vertical direction, thereby fitting in the inner wall 41*a* of the downward conveyance path 41. In such a case, the floating member 45 does not float, and the function of preventing toner from adhering to the inner wall 41*a* is not attained.

Figure 7:
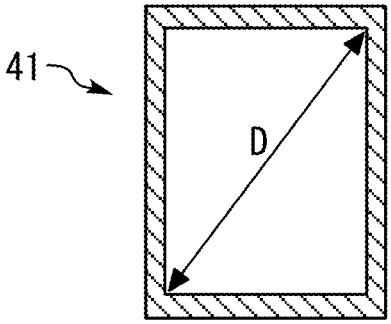
FIG. 7 is a cross-sectional view illustrating an example of the downward conveyance path.

On the other hand, in the present embodiment, since the length H of the floating member 45 is sufficiently greater than the diameter D of the cross-section of the downward conveyance path 41, thereby reducing such a problem. Note that, when the cross-section inside the downward conveyance path 41 is rectangular as illustrated in FIG. 7, the length of the diagonal of the cross-section is defined as the diameter D of the cross-section.

In the present embodiment, the specific gravity of the floating member 45 is greater than the specific gravity of excess toner (developer). Thus, the floating member 45 is less likely to rise greatly above the transport screw 43 via excess toner because a large amount of excess toner is not interposed between the transport screw 43 and the floating member 45.

That is, even when a large amount of excess toner is in the transverse conveyance path 42, the floating member 45 sinks into the excess toner and comes into contact with the transport screw 43 due to difference of the specific gravity. Therefore, the floating member 45 can come into contact with the rotating transport screw 43 and float in the downward conveyance path 41, thereby maintaining the effect of preventing toner from adhering to the inner wall 41*a*.

Figure 8:
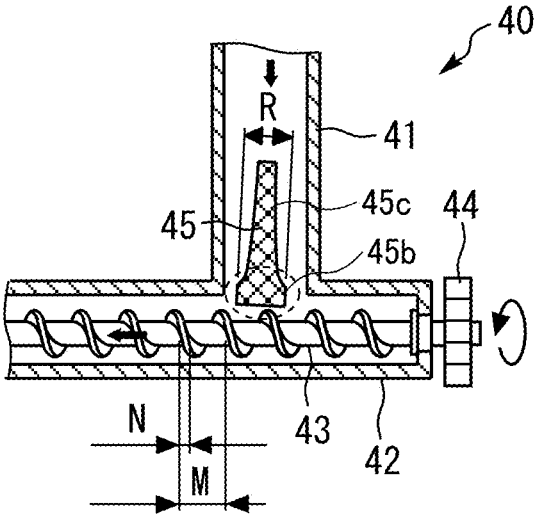
FIG. 8 is a cross-sectional view of a part of an excess toner conveyance device according to a first variation of the present disclosure.

As illustrated in FIG. 8, an excess toner conveyance device 40 according to a first variation includes a floating member 45 whose bottom portion 45*b* of enlarged diameter surrounded by the broken-line circle in FIG. 8 bulges. Thus, the bulging bottom portion 45*b* and a slim portion 45*c* other than the bottom portion of the floating member 45 can reduce the weight of the floating member 45 and minimize wear of the transport screw 43 and the floating member 45 while preventing the floating member 45 from entering between the threads 43*b* of the transport screw 43.

Figure 9:
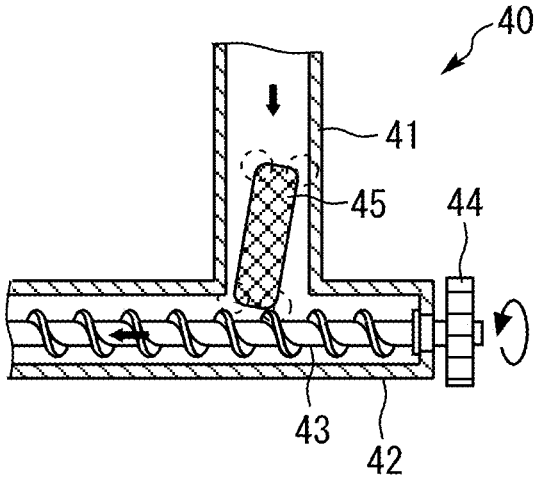
FIG. 9 is a cross-sectional view of a part of an excess toner conveyance device according to a second variation of the present disclosure.

As illustrated in FIG. 9, an excess toner conveyance device 40 according to a second variation includes a floating member 45 having rounded corners surrounded by the broken-line circles in FIG. 9. Specifically, the corners of the columnar floating member 45 are chamfered. Such a floating member 45 reduces the contact pressure with the transport screw 43, thereby minimizing wear of the transport screw 43 and the floating member 45.

To prevent the rounded corner portion of the floating member 45 from entering between the threads 43*b* of the transport screw 43, preferably, the diameter of the bottom face that is not rounded is greater than the screw pitch M of the transport screw 43. In addition to the rounded corner portions of the floating member 45 only at the bottom to attain the above-described effect, all corner portions of the floating member 45 including the ceiling portion are chamfered. As a result, the floating member 45 with no orientation facilitates assembly of the floating member 45 to the excess toner conveyance device 40.

Figure 10:
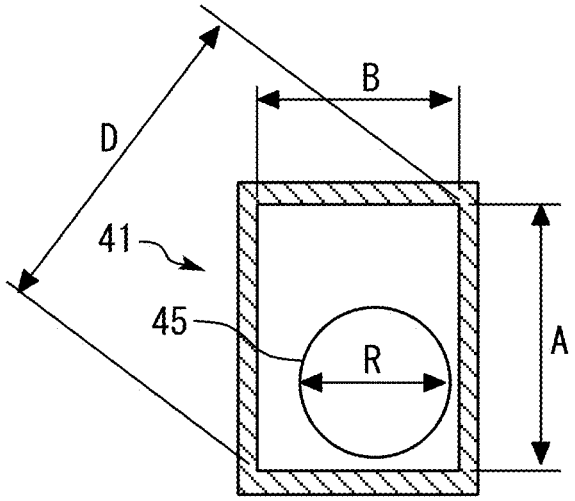
FIG. 10 is a cross-sectional view of a downward conveyance path according to a third variation of the present disclosure.

As illustrated in FIG. 10, an excess toner conveyance device 40 according to a third variation includes a downward conveyance path 41 having a rectangular cross-section therein. The columnar floating member 45 made of a rubber material is provided in the downward conveyance path 41. In the third variation, the diameter R of the floating member 45 is 40% or more of the diagonal length (the diameter D) of the cross-section of the downward conveyance path 41 (i.e., $R \geq D \times 0.4$).

Specifically, the cross-section of the downward conveyance path 41 has a long side length A of about 17.2 mm, a short side length B of about 13.6 mm, and the diameter D of the cross-section of about 21.93 mm. The diameter R of the floating member 45 is about 10 mm. Satisfying the above-described relation $R \geq D \times 0.4$ can prevent excess toner from adhering to the inner wall of the downward conveyance path 41 without causing the malfunction or breakage of the transport screw 43.

As described above, the excess toner conveyance device 40 as a developer conveyance device in the above-described embodiments includes the downward conveyance path 41 in which excess toner as a developer falls under gravity, the transverse conveyance path 42 communicating with the lower end of the downward conveyance path 41 and extending in the transverse direction intersecting with the downward conveyance path 41, and the transport screw 43 disposed in the transverse conveyance path 42. The transport screw 43 is configured to rotate in a predetermined direction to transport the excess toner in the transverse direction. The excess toner conveyance device 40 further includes the floating member 45 movably disposed in the downward conveyance path 41 and configured to contact the transport screw 43 rotating in the predetermined direction to float in the downward conveyance path 41.

This configuration can prevent excess toner from adhering to the inner wall 41*a* of the downward conveyance path 41 without causing the malfunction or breakage of the transport screw 43.

According to the present disclosure, a developer conveyance device and an image forming apparatus incorporating the developer conveyance device can be provided that can prevent a developer from adhering to the inner wall of the downward conveyance path without causing the malfunction or breakage of the transport screw.

In the above-described embodiments, the present disclosure is applied to the excess toner conveyance device 40 as a developer conveyance device in which untransferred toner collected by the cleaning device 15 or the belt cleaning device 9 is transported as excess toner toward the excess toner receptacle 30. However, the present disclosure is not limited to the above-described embodiments, and can readily be applied to, for example, an excess toner conveyance device in which only untransferred toner collected in the cleaning device 15 for the photoconductor drum 11 is transported as excess toner toward the excess toner receptacle 30.

Further, in the above-described embodiments, the present disclosure is applied to the excess toner conveyance device 40 as a developer conveyance device in which excess toner as a developer is transported. However, the present disclosure is not limited to the above-described embodiments, and can readily be applied to, for example, a developer conveyance device in which untransferred toner collected by the cleaning device 15 is transported as recycle toner toward the developing device 13, a developer conveyance device in which fresh toner or two-component developer is transported toward the developing device 13, or the like.

In such configurations, effects similar to those of the above-described embodiments are also attained.

The above-described embodiments are illustrative and do not limit the present disclosure. Thus, numerous additional modifications and variations are possible in light of the above teachings. It is therefore to be understood that within the scope of the present disclosure, the present disclosure may be practiced otherwise than as specifically described herein. The number, position, and shape of the components described above are not limited to those embodiments described above. Desirable number, position, and shape can be determined to perform the present disclosure.

What is claimed is:

1. A developer conveyance device comprising:

a downward conveyance path in which a developer falls under gravity;

a transverse conveyance path communicating with a lower end of the downward conveyance path and extending in a transverse direction intersecting with the downward conveyance path;

a transport screw disposed in the transverse conveyance path and configured to rotate in a predetermined direction to transport the developer in the transverse direction; and a floating member configured to contact the transport screw rotating in the predetermined direction to float in the downward conveyance path, wherein the floating member has a columnar shape.

2. The developer conveyance device according to claim 1, wherein the floating member is softer than the transport screw.

3. The developer conveyance device according to claim 1, wherein the floating member is softer than an inner wall of the downward conveyance path.

4. The developer conveyance device according to claim 1, wherein the floating member is elastic.

5. The developer conveyance device according to claim 1, wherein the floating member has a hollow tubular shape.

6. The developer conveyance device according to claim 1, wherein the developer conveyance device satisfies a relation $R > M - N$, where R represents a diameter of an inscribed circle of a bottom face of the floating member, M represents a screw pitch of the transport screw, and N represents a thickness of a thread of the transport screw.

7. The developer conveyance device according to claim 1, wherein the developer conveyance device satisfies a relation H>D, where H represents a length of the floating member, and D represents an inner diameter of a cross-section of the downward conveyance path.

8. The developer conveyance device according to claim 1, wherein a specific gravity of the floating member is greater than a specific gravity of the developer.

9. The developer conveyance device according to claim 1, wherein the developer is excess toner.

10. An image forming apparatus comprising the developer conveyance device according to claim 1.

11. The developer conveyance device according to claim 1, wherein:

the columnar shape of the floating member is cylindrical.

12. A developer conveyance device comprising:

a downward conveyance path in which a developer falls under gravity;

a transverse conveyance path communicating with a lower end of the downward conveyance path and extending in a transverse direction intersecting with the downward conveyance path;

a transport screw disposed in the transverse conveyance path and configured to rotate in a predetermined direction to transport the developer in the transverse direction; and a structure within the downward conveyance path, the structure floating in the downward conveyance path and having a columnar shape.

13. The developer conveyance device according to claim 12, wherein the structure within the downward conveyance path is softer than the transport screw.

14. The developer conveyance device according to claim 12, wherein the structure within the downward conveyance path is softer than an inner wall of the downward conveyance path.

15. The developer conveyance device according to claim 12, wherein the structure within the downward conveyance path is elastic.

16. The developer conveyance device according to claim 12, wherein the structure within the downward conveyance path has a hollow tubular shape.

17. The developer conveyance device according to claim 12, wherein the developer conveyance device satisfies a relation R>M−N, where R represents a diameter of an inscribed circle of a bottom face of the structure within the downward conveyance path, M represents a screw pitch of the transport screw, and N represents a thickness of a thread of the transport screw.

18. The developer conveyance device according to claim 12, wherein the developer conveyance device satisfies a relation H>D, where H represents a length of the structure within the downward conveyance path, and D represents an inner diameter of a cross-section of the downward conveyance path.

19. The developer conveyance device according to claim 12, wherein a specific gravity of the structure within the downward conveyance path is greater than a specific gravity of the developer.

20. The developer conveyance device according to claim 12, wherein:

the columnar shape of the structure within the downward conveyance path is cylindrical.

* * * * *